US011437760B2

(12) United States Patent
Gingrich, III et al.

(10) Patent No.: US 11,437,760 B2
(45) Date of Patent: Sep. 6, 2022

(54) FLOATING COAXIAL CONNECTOR WITH A STABILIZING RING AT THE MATING END

(71) Applicant: TE Connectivity Services GmbH, Schaffhausen (CH)

(72) Inventors: Charles Raymond Gingrich, III, Mechanicsburg, PA (US); Francis John Blasick, Halifax, PA (US); Keith Edwin Miller, Manheim, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 16/909,229

(22) Filed: Jun. 23, 2020

(65) Prior Publication Data

US 2021/0399468 A1 Dec. 23, 2021

(51) Int. Cl.

| | |
|---|---|
| ***H01R 13/631*** | (2006.01) |
| ***H01R 13/426*** | (2006.01) |
| ***H01R 24/40*** | (2011.01) |
| ***H01R 13/642*** | (2006.01) |

(52) U.S. Cl.

CPC ..... *H01R 13/6315* (2013.01); *H01R 13/426* (2013.01); *H01R 13/642* (2013.01); *H01R 24/40* (2013.01)

(58) Field of Classification Search

CPC ..... H01R 13/6315; H01R 13/426; H01R 13/642; H01R 13/2421; H01R 24/38

See application file for complete search history.

(56) References Cited

U.S. PATENT DOCUMENTS

| | | | | |
|---|---|---|---|---|
| 4,697,859 A * | 10/1987 | Fisher, Jr. | ..... | H01R 13/6315 439/246 |
| 4,867,698 A * | 9/1989 | Griffiths | ..... | H01R 24/40 439/317 |
| 5,746,617 A | 5/1998 | Porter, Jr. et al. | | |
| 6,296,492 B1 * | 10/2001 | Fujimoto | ..... | H01R 24/46 439/63 |

(Continued)

FOREIGN PATENT DOCUMENTS

| | | |
|---|---|---|
| CN | 203 983 666 U | 12/2014 |
| CN | 109 950 719 A | 6/2019 |
| JP | 2007 087682 A | 4/2007 |

OTHER PUBLICATIONS

European Search Report, dated Nov. 23, 2021, EP 21 18 0603, European Application No. 21180603.9-1201.

*Primary Examiner* — Vanessa Girardi

(57) ABSTRACT

A coaxial connector assembly has a housing with at least one contact receiving cavity which extends from a mating end to a contact assembly receiving end. The contact receiving cavity has a mounting section proximate the contact assembly receiving end. A contact assembly is positioned in the contact receiving cavity. The contact assembly has a front flange proximate a mating portion of the contact assembly. A positioning member is inserted on the mating portion of the contact assembly. The positioning member cooperates with the flange to position the positioning member on the mating portion of the contact assembly. The positioning member cooperates with a wall of the contact receiving cavity to limit the movement of the mating portion of the contact assembly in a direction which is transverse to a longitudinal axis of the contact assembly.

12 Claims, 4 Drawing Sheets

(56) References Cited

U.S. PATENT DOCUMENTS

| | | | | |
|---|---|---|---|---|
| 7,704,077 | B1 | 4/2010 | Morley | |
| 9,979,132 | B1 * | 5/2018 | Flaherty, IV ..... | H01R 13/7032 |
| 2019/0221969 | A1 | 7/2019 | Ruffini et al. | |

* cited by examiner

FLOATING COAXIAL CONNECTOR WITH A STABILIZING RING AT THE MATING END

FIELD OF THE INVENTION

The present invention is directed to coaxial connector in which sag is reduced. In particular, the invention is coaxial connector which limits contact sag and prevents stubbing when mated to a mating connector.

BACKGROUND OF THE INVENTION

Pluggable electrical connectors have applications in many electronic environments for such uses as connecting component modules to mother boards, connecting component modules to other component modules, as well as various other electronic systems packaging configurations. Pluggable connectors permit rapid access to the individual components for maintenance or repair functions. Such connectors are particularly desirable for use in "blind mate connector" applications in which a plug-in type module or chassis is generally connected at a rear face thereof to a recessed, or other substantially inaccessible location in a rack system or similar component.

Most high performance radio frequency (RF) and microwave applications employ coaxial transmission lines and thus, it is desirable to employ blind mate connectors adapted for connecting coaxial cable. This latter use, however, tends to be somewhat problematic. A principle requirement for such a pluggable electrical connector is to provide a convenient connection means which effects an acceptably low disturbance of the electrical signals being transmitted or carried between the coupled components. This is particularly critical in RF and microwave applications, where electrical connector assembly performance characteristics can heavily influence impedance matching and total electrical systems performance. Indeed, it is desirable to keep microwave transmission lines uninterrupted from source to destination.

Coaxial cabling typically consists of a central conductor material surrounded by an outer conductor material and insulated with a dielectric material between conductors. To achieve maximum electrical efficiency, the cable segments must be axially, radially and angularly aligned to high precision, as well as placed in mutual contact. The alignment and spacing requirements are exceedingly demanding due to the minute size and delicate nature of conductor materials.

The situation becomes more complex in configurations in which a chassis having a series of male bulkhead or plug assemblies must engage and mate a series of fixed rack mounted connectors. Moreover, this problem is exacerbated in typical rack and chassis type applications, in which the connectors are used in "blind mating" configurations where access to the connector interface is restricted. In these and other similar installations stubbing of the contacts can occur if the contacts sag and are not properly aligned.

It is therefore desirable to provide a coaxial connector which limits contact sag, wherein as a mating connector is blindly mated to the connector, the proper positioning of the contact will eliminate stubbing when the mating connector is moved into electrical and mechanical engagement with the connector.

SUMMARY OF THE INVENTION

An embodiment is directed to a coaxial connector assembly. The coaxial connector assembly has a housing with a mating end and an oppositely facing contact assembly receiving end, The housing has at least one contact receiving cavity which extends from the mating end to the contact assembly receiving end. The contact receiving cavity has a mounting section proximate the contact assembly receiving end. A contact assembly is positioned in the contact receiving cavity. The contact assembly has a shell and a center contact. A retainer portion is coupled to the shell and positioned proximate the mounting section of the contact receiving cavity. The contact assembly has a front flange proximate a mating portion of the contact assembly. A positioning member is inserted on the mating portion of the contact assembly. The positioning member cooperates with the flange to position the positioning member on the mating portion of the contact assembly. The positioning member cooperates with a wall of the contact receiving cavity to limit the movement of the mating portion of the contact assembly in a direction which is transverse to a longitudinal axis of the contact assembly.

An embodiment is directed to a coaxial connector assembly. The coaxial connector assembly has a housing with a mating end and an oppositely facing contact assembly receiving end, The housing has at least one contact receiving cavity which extends from the mating end to the contact assembly receiving end. The contact receiving cavity has a mounting section proximate the contact assembly receiving end. A contact assembly is positioned in the contact receiving cavity. The contact assembly has a shell and a center contact. A retainer portion is coupled to the shell and positioned proximate the mounting section of the contact receiving cavity. The contact assembly has a front flange proximate a mating portion of the contact assembly. A positioning member is positioned proximate the mating portion and proximate the flange. The positioning member cooperates with the flange to limit the movement of the mating portion of the contact assembly in a direction which is transverse to a longitudinal axis of the contact assembly.

An embodiment is directed to a coaxial connector assembly having a housing with a mating end and an oppositely facing contact assembly receiving end. The housing has at least one contact receiving cavity which extends from the mating end to the contact assembly receiving end. The contact receiving cavity has a mounting section proximate the contact assembly receiving end. A contact assembly is provided in the contact receiving cavity and has a shell and a center contact. A retainer portion is coupled to the shell and positioned proximate the mounting section of the contact receiving cavity The contact assembly has a front flange proximate a mating portion of the contact assembly. A positioning ring is positioned on the mating portion of the contact assembly. The positioning ring has an opening provided in the center. An outer diameter of the positioning ring is smaller than a diameter of the contact receiving cavity but greater than a diameter of the flange. An inner diameter of the opening is equal to a diameter of the mating end of the contact assembly. The positioning ring may have a slot which extends from the opening to an outside circumference of the positioning ring to allow the positioning ring to be resiliently retained on the mating portion of the contact assembly. The positioning ring limits the movement of the mating portion of the contact assembly in a direction which is transverse to a longitudinal axis of the contact assembly.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
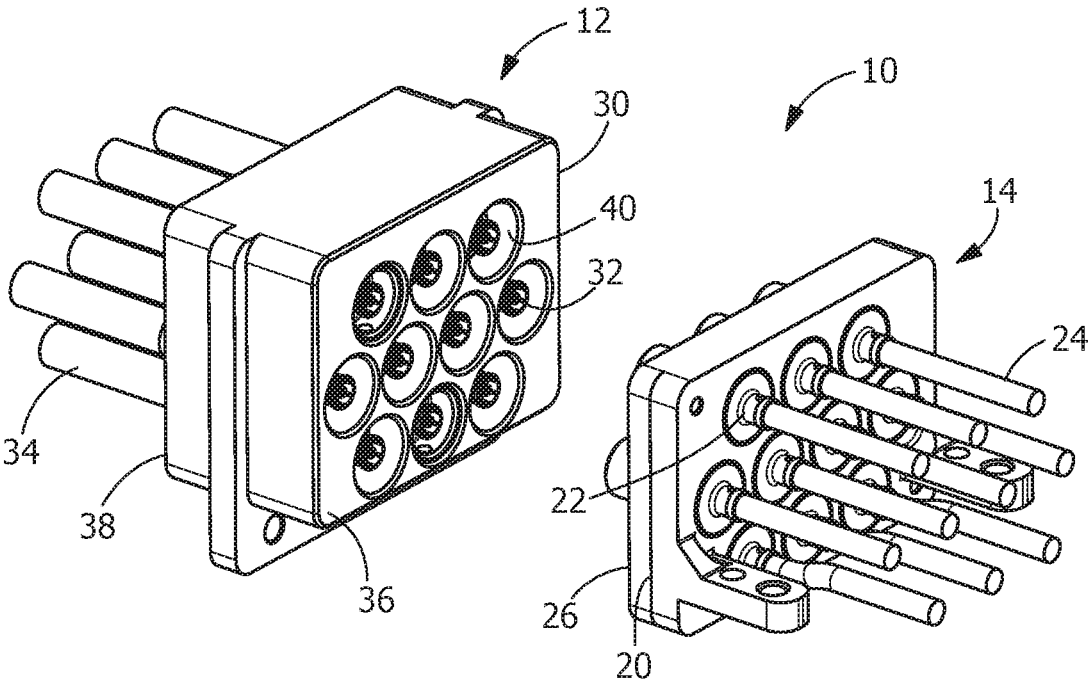
FIG. 1 is a perspective view of an illustrative backplane connector and a mating daughtercard connector prior to being mated together.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

FIG. 1 illustrates an electrical connector system 10 including a first electrical connector assembly 12 and a second electrical connector assembly 14. The first electrical connector assembly 12 and the second electrical connector assembly 14 are configured to be mated together. In the illustrative embodiment, the first electrical connector assembly 12 is a backplane assembly and the second electrical connector assembly is a daughtercard assembly, however the invention is not limited to this configuration.

The second electrical connector assembly 14 includes a housing 20 and a plurality of electrical contacts 22 held within the housing 20. Any number of electrical contacts 22 may be utilized depending on the particular application. In the illustrated embodiment, the electrical contacts 22 are cable mounted to respective coaxial cables 24. Alternatively, the electrical contacts 22 may be terminated to a daughtercard (not shown). The electrical contacts 22 may be terminated to the daughtercard with the daughtercard oriented parallel to a mating face 26 of the second connector assembly 14, or alternatively, the daughtercard may be at another angle, such as perpendicular and the electrical contacts 22 may be right angle electrical contacts 22.

The first electrical connector assembly 12 includes a housing 30 and a plurality of electrical contact assemblies 32 held within the housing 30. The electrical contact assemblies 32 are mounted to respective coaxial cables 34. Alternatively, the contact assemblies 32 may be terminated to a backplane (not shown). The housing 30 has a mating end 36 and an oppositely facing contact assembly receiving end 38. Contact receiving cavities 40 extend from the mating end 36 to the contact assembly receiving end 38. The contact receiving cavities 40 have mounting sections 42 provide proximate the contact assembly receiving end 38. The contact receiving cavities 40 have an inside wall with an inside diameter D1, while the mounting sections 42 have a reduced diameter of D2.

The first electrical connector assembly 12 and the second electrical connector assembly 14 are mated with one another such that the electrical contacts 22 mate with the contact assemblies 32. In alternative embodiments, the first electrical connector assembly 12 and the second electrical connector assembly 14 are both board mounted, or alternatively, one of the first electrical connector assembly 12 and the second electrical connector assembly 14 are cable mounted, while the other is board mounted.

Figure 2:
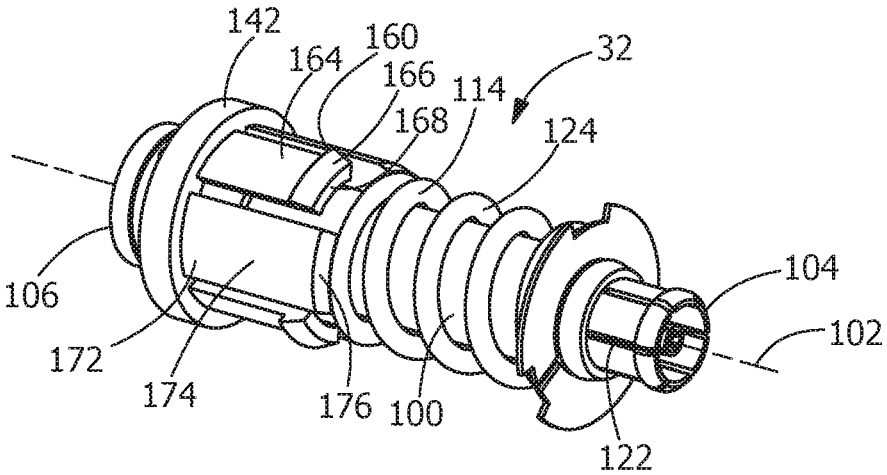
FIG. 2 is a perspective view of a first illustrative embodiment of a coaxial contact for use in the backplane connector of FIG. 1.
Figure 3:
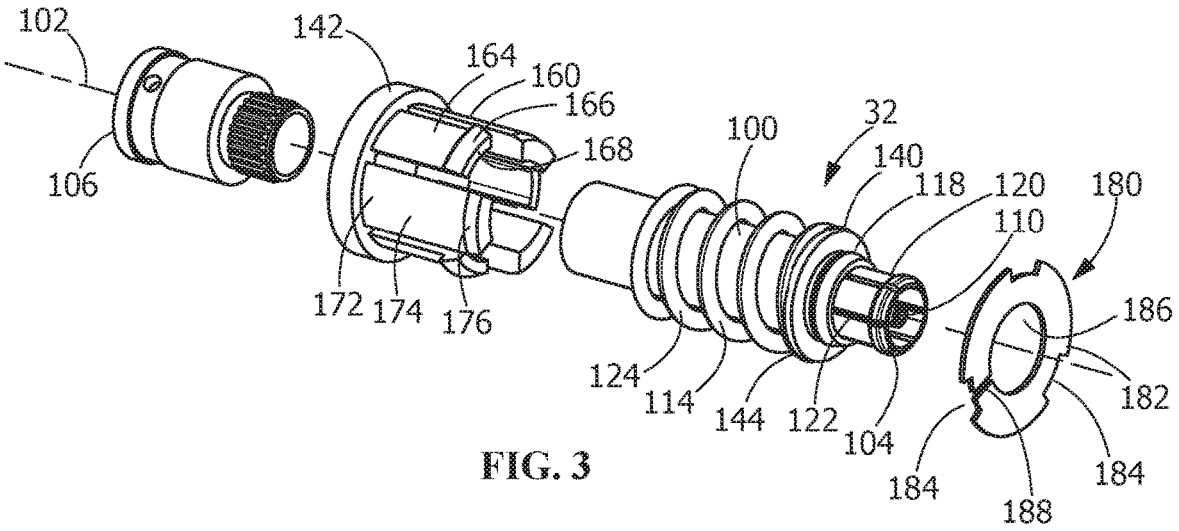
FIG. 3 is an exploded perspective view of the coaxial contact of FIG. 2.
Figure 4:
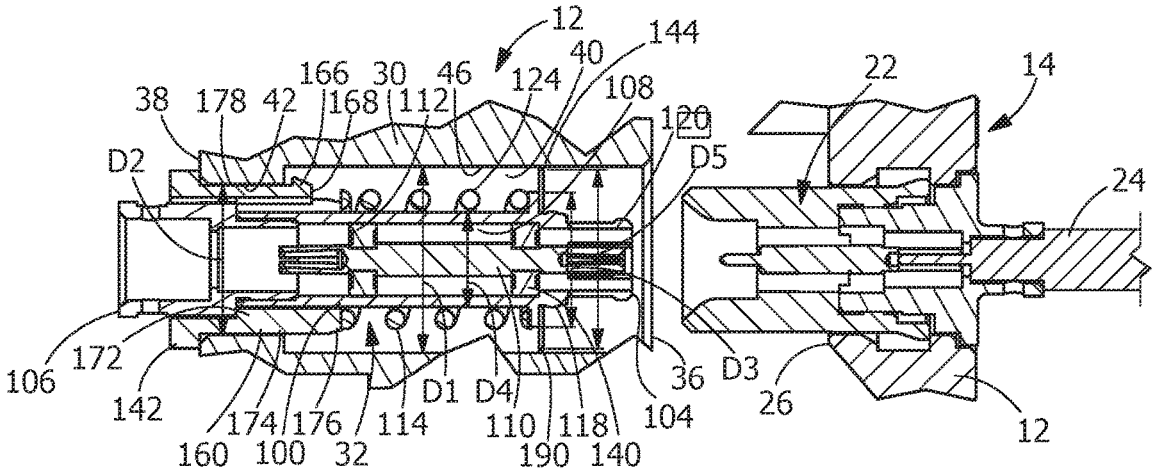
FIG. 4 is a cross-sectional view showing the coaxial contact of FIG. 2 inserted into a contact receiving cavity of the backplane connector of FIG. 1.

FIG. 2 is a perspective view of one of the contact assemblies 32. FIG. 3 is an exploded view of the contact assembly 32. The contact assembly 32 includes a shell 100 extending along a central longitudinal axis 102 between a mating end 104 and a cable end 106. The shell 100, as shown in FIG. 4, defines a shell cavity 108. The contact assembly 32 includes a center contact 110 held within the shell cavity 108. A dielectric body 112 is positioned between the shell 100 and the contact 110. The shell 100 is formed from a conductive material, such as a metal material, and the dielectric body 112 electrically separates the contact 110 and the shell 100. The shell 100 defines an outer contact. The shell 100 and the center contact 110 are configured as a coaxial contact assembly. The contact assembly 32 includes a spring 114 concentrically surrounding a portion of the shell 100. The contact assembly 32 includes a rear retainer 160 used to retain the spring 114 in position with respect to the shell 100. The rear retainer 160 is used to secure the contact assembly 32 to the housing 30 of the first electrical connector assembly 12.

The shell 100 is generally cylindrical in shape and may be stepped along the length having portions of different diameters. The mating end 104 defines a plug which has ring retention projections 118. The shell 100 includes tines 120 at the mating end 104 configured to be received within the mating electrical connector 22. The tines 120 are separated by gaps 122 and are movable with respect to one another such that the tines 120 may be deflected toward one another to reduce the diameter of the mating end 104 for mating with the electrical connector 22. Deflection of the tines 120 may cause a friction fit with the electrical connector 22 when mated.

The spring 114 has a helically wound body 124 extending between the mating end 104 and the cable end 106. The spring 114 is compressible axially.

The shell 100 includes a front flange 140. The front flange 140 includes an outer circumferential edge 144 having a diameter D3 greater than the diameter D4 of adjacent portions of the shell 100. The outer edge 144 may extend around the entire perimeter of the front flange 140. The front flange 140 is proximate to, but spaced from, the ring retention projections 118.

The retainer 160, which is positioned on the cable end 106 of the shell 100, includes a rear flange 142. Latch arms 164 extend from the rear flange 142. Latching projections 166 are provided at the free ends 168 of the latch arms 164. Stabilizing arms 172 also extend from the rear flange. Bearing surfaces 174 are provided on the stabilizing arms 172. The bearing surfaces 174 extend from proximate the rear flange to proximate free ends 176 of the stabilizing arms 172.

When assembled, as shown in FIG. 4, the retainer 160 is positioned proximate a mounting projections 42 of the housing 30 of the second connector assembly 14. In this position, the latching projections 166 of the latch arms 164 and the rear flange 142 are provided on either side of the mounting projection 42 to prevent unwanted movement of the contact assembly 32 in a direction parallel to the longitudinal axis 102 of the contact assembly 32.

In the assembled position, the bearing surfaces 174 of the stabilizing arms 172 are positioned proximate to the mounting projection 42. A space 178 is provided between the bearing surfaces 174 and the mounting projection 42. This allows the contact assembly 32 to move or float relative to the housing 30 in a direction which is perpendicular to the longitudinal axis 102 of the contact assembly 32. However, because of manufacturing tolerances, it is difficult to precisely control the amount of float or movement which occurs at the mating end 104 of the contact assembly 32.

While movement or float of the mating end 104 is beneficial, excessive movement or float is not beneficial, as the mating end 104 of the contact assembly 32 may stub or bind against the contacts 22 when the first connector assembly 12 and the second connector assembly 14 are mated. In current connectors, excessive movement may occur when an extreme pull force is applied to the cable, causing the front end to move excessively.

In order to prevent such stubbing, a stabilizing ring 180 is provided. The stabilizing ring 180 may be made of metal, plastic or other material having the rigid characteristics desired. As shown in FIG. 3, the stabilizing ring 180 has an outer circumferential edge 182 having a diameter of D5 which is greater than the diameter D3 of the flange 140 and less than the diameter D1 of the contact receiving cavities 40. Tooling recesses 184 are positioned periodically about the edge 182. The tooling recesses 184 allow for a removal tool (not shown) to access and move latching projections 166 to allow the contact assemblies 32 to be removed from the housing 30 of the first electrical connector assembly 12.

An inner opening 186 is provided in the stabilizing ring 180. The diameter of the opening 186 is dimensioned to be approximate to or slightly smaller than the diameter of the contact assembly 32 proximate the flange 140. A slot 188 may be provided in the stabilizing ring 180 to allow the stabilizing ring 180 to be resiliently expanded as the stabilizing ring 180 is moved onto the contact assembly 32.

When assembled, the stabilizing ring 180 is positioned between the flange 140 and the ring retention projections 118. The stabilizing ring 180 is retained in position by the frictional engagement between the wall of the opening 186 and the contact assembly 32. The stabilizing ring 180 is also held in position by the flange 140 and the ring retention projections 118.

With the contact assembly 32, with the stabilizing ring 180 positioned in the contact receiving cavity 40, a circumferentially extending gap 190 is provided between the outer circumferential edge 182 and the inner wall 46 of the contact receiving cavity 40. The circumferentially extending gap 190 is equal to ½ (D1–D5). In the embodiment shown, the gap is equal to 0.010 inches. However, other dimensions of the gap may be used.

The positioning of the stabilizing ring 180 proximate the mating end 104, allows for the controlled movement of float of the mating end 104 relative to the contact receiving cavity 40, thereby allowing the contact assembly 32 to compensate for any slight misalignment of the contact assembly 32 and the mating contact 22. However, as the gap 190 is controlled, excessive movement or float of the mating end 104 of the contact assembly 32 is prevented, as the outer circumferential edge 182 will engage the inner wall 46 of the contact receiving cavity 40 to limit the movement of the mating end 104, even when an extreme pull force is applied to the cable. Contact stubbing is thereby prevented.

Figure 5:
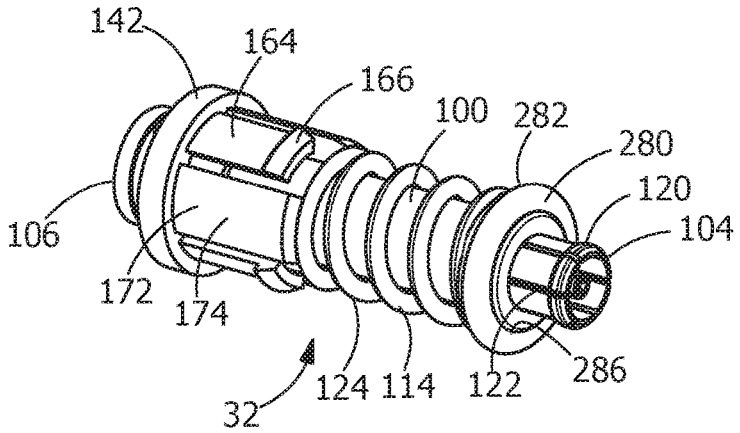
FIG. 5 is a perspective view of a second illustrative embodiment of a coaxial contact.
Figure 6:
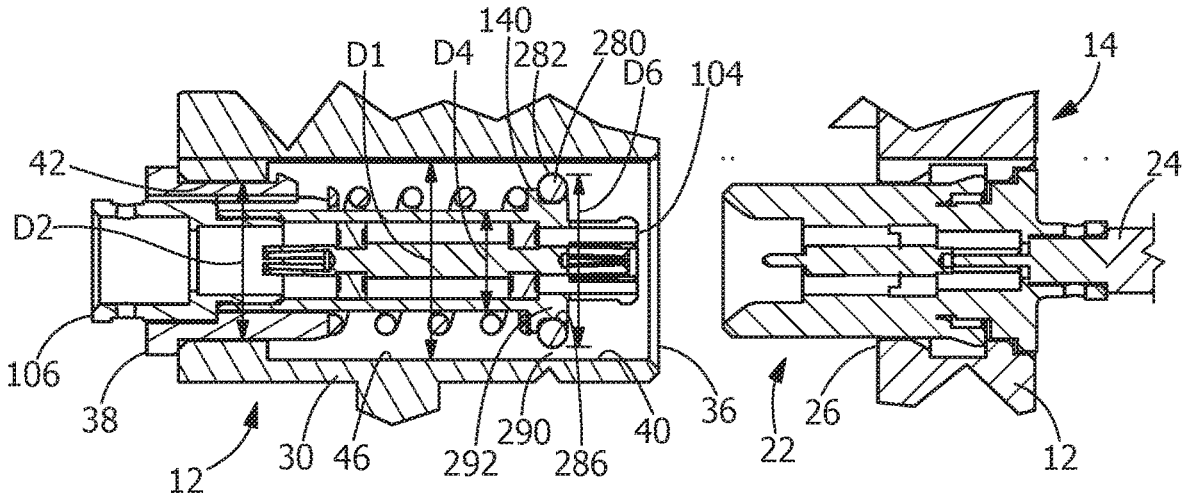
FIG. 6 is a cross-sectional view showing the coaxial contact of FIG. 5 inserted into a contact receiving cavity of a backplane connector.

As shown in FIGS. 5 and 6, an alternate embodiment of a stabilizing ring 280 is provided. The stabilizing ring 280 may be made of rubber or other material having the resilient characteristics desired. In this embodiment, the connector assembly 12 and the contact assembly 32 are similar to that shown in FIGS. 1 through 4. Therefore, references numbers shown in FIGS. 5 and 6 which are identical to the reference numbers shown in FIGS. 1 through 4 are used to represent the same components previously described.

As shown in FIG. 5, the stabilizing ring 280 has an outer circumferential edge 282 having a diameter of D6 which is greater than the diameter D3 of the flange 140 and equal to or less than the diameter D1 of the contact receiving cavities 40. An inner opening 286 is provided in the stabilizing ring 180. The diameter of the opening 286 is dimensioned to be approximate to or slightly smaller than the diameter of a ring retention section 292 of the contact assembly 32 proximate the flange 140.

When assembled, the stabilizing ring 280 is positioned proximate the flange. The stabilizing ring 280 is retained in position by the frictional engagement between the wall of the opening 286 and the contact assembly 32.

With the contact assembly 32, with the stabilizing ring 280 positioned in the contact receiving cavity 40, a circumferentially extending gap 290 may be provided between the outer circumferential edge 282 and the inner wall 46 of the contact receiving cavity 40. Alternatively, no gap may be provided. The existence and size of the gap 292 is dependent upon the material used for the stabilizing ring 290. If the material is compressible, no gap may be needed, as the stabilizing ring 292 can compress to accommodate the needed movement or float of the mating end 104. If the material is not easily compressible, a gap may be needed to accommodate the needed movement or float of the mating end 104.

The positioning of the stabilizing ring 280 proximate the mating end 104, allows for the controlled movement of float of the mating end 104 relative to the contact receiving cavity 40, thereby allowing the contact assembly 32 to compensate for any slight misalignment of the contact assembly 32 and the mating contact 22. However, as the stabilizing ring 280 controls the movement of the mating end 104, excessive movement or float of the mating end 104 of the contact assembly 32 is prevented, as the outer circumferential edge 282 will engage the inner wall 46 of the contact receiving cavity 40 to limit the movement of the mating end 104, even when an extreme pull force is applied to the cable. Contact stubbing is thereby prevented.

As the stabilizing ring 280 may be made of rubber or other material having the resilient characteristics desired, The stabilizing ring 280 may be elastically deformed as a removal tool (not shown) is inserted into the contact receiving cavity 40, thereby allowing the removal tool to access and move latching projections 166 to allow the contact assemblies 32 to be removed from the housing 30 of the first electrical connector assembly 12.

Figure 7:
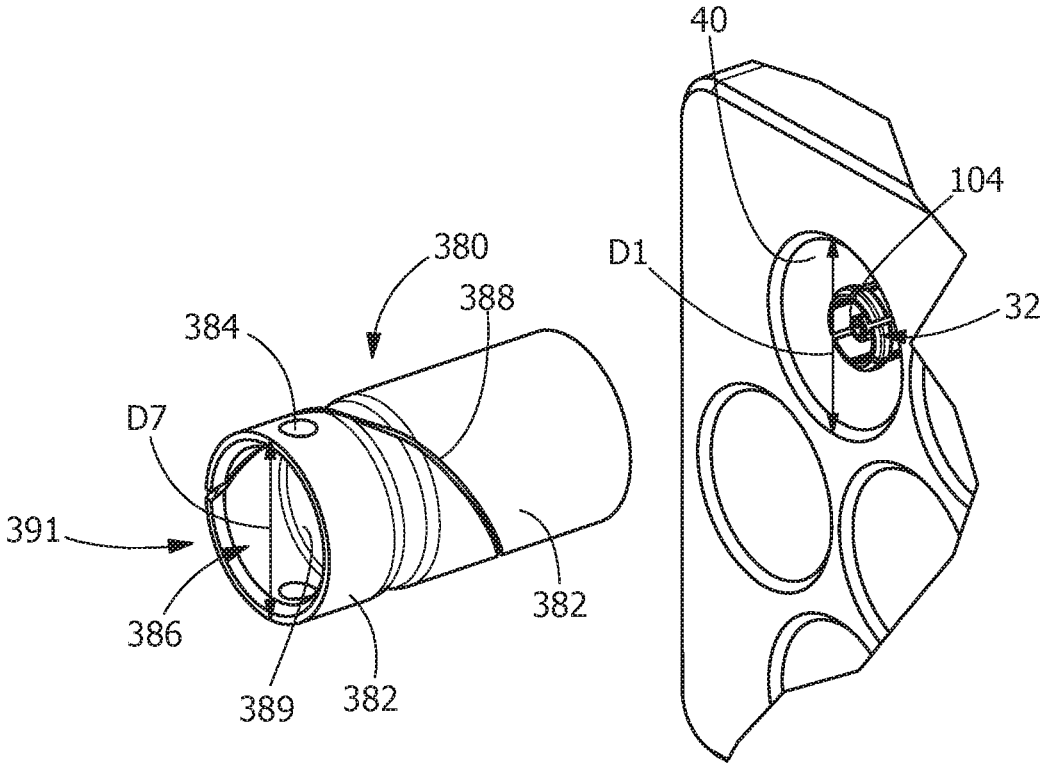
FIG. 7 is a perspective view of a an illustrative embodiment of an insert shown prior to insertion into a backplane connector.
Figure 8:
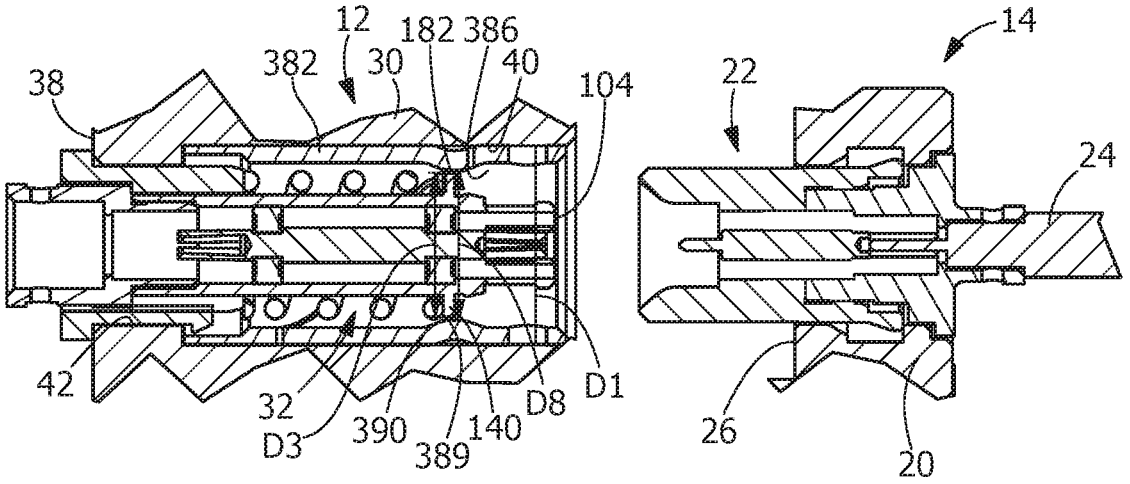
FIG. 8 is a cross-sectional view showing the coaxial contact of FIG. 8 inserted into a contact receiving cavity of a backplane connector.

As shown in FIGS. 7 and 8, a second alternate embodiment is shown. In this embodiment, a stabilizing insert 380 is positioned in the contact receiving cavity 40. The stabilizing insert 380 may be made of metal, plastic or other material having the characteristics desired. As shown in FIG. 7, the stabilizing insert 380 has a cylindrical configuration with an outer circumferential wall 382 having a diameter of D7 which is greater than, but approximately equal to the diameter D1 of the contact receiving cavities 40, thereby allowing the inserts 380 to be retained in the cavities 40. Tooling openings 384 are positioned periodically about the circumference of the wall 382. An inner opening 386 is provided in the stabilizing insert 380. The diameter of the opening 386 is dimensioned to allow the contact assembly 32 to extend therethrough. A slot 388 is provided in the stabilizing insert 380 to allow the stabilizing insert 380 to be resiliently contracted and expanded as the stabilizing insert 380 is moved onto the contact receiving cavity 40, thereby allowing the stabilizing insert 380 to have an interference fit with the contact receiving cavity 40 to maintain the stabilizing insert 380 in the contact receiving cavity 40.

A flange engaging projection 389 is provided on the stabilizing insert 380. A shown in FIG. 7, the flange engaging projection 389 is spaced from a free end 391 of the stabilizing insert 380. The flange engaging projection 389 extends about the circumference of the wall 382 of the stabilizing insert 380. However, other configurations of the flange engaging projection 389 may be used. As shown in FIG. 8, the flange engaging projection 389 extends into the opening 386. The diameter D8 between the flange engaging projection 389 is larger than the diameter D3 of the flange 140.

When assembled, the stabilizing insert 380 is positioned in the contact receiving cavity 40. In this position, as shown in FIG. 8, the flange engaging projection 389 is positioned in line and proximate to the flange 140. With stabilizing insert 380 positioned in the contact receiving cavity 40, a circumferentially extending gap 390 is provided between an outer circumferential edge 182 of the flange 140 and the and the flange engaging projection 389. The circumferentially extending gap 390 is equal to ½ (D8–D3). In the embodiment shown, the gap is equal to 0.010 inches. However, other dimensions of the gap may be used.

The positioning of the flange engaging projection 389 proximate the flange 140 at the mating end 104, allows for the controlled movement of float of the mating end 104 relative to the contact receiving cavity 40, thereby allowing the contact assembly 32 to compensate for any slight misalignment of the contact assembly 32 and the mating contact 22. However, as the gap 390 is controlled, excessive movement or float of the mating end 104 of the contact assembly 32 is prevented, as the outer circumferential edge 182 will engage the flange engaging projection 389 of the stabilizing insert 380 positioned in the contact receiving cavity 40 to limit the movement of the mating end 104, even when an extreme pull force is applied to the cable. Contact stubbing is thereby prevented.

The stabilizing insert 380 can be removed using a removal tool (not shown). The removal tool may be inserted through the tooling openings 384 to access the latching projections 166 to move or depress the latching projections 166.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A coaxial connector assembly comprising:

a housing having a mating end and an oppositely facing contact assembly receiving end, the housing having at least one contact receiving cavity which extends from the mating end to the contact assembly receiving end, the contact receiving cavity having a mounting section proximate the contact assembly receiving end;

a contact assembly having a shell and a center contact, a retainer portion coupled to the shell and positioned proximate the mounting section of the contact receiving cavity, the contact assembly having a front flange proximate a mating portion of the contact assembly;

a stabilizing ring positioned on the mating portion of the contact assembly, the stabilizing ring having an opening provided in the center, an outer diameter of the stabilizing ring being smaller than a diameter of the contact receiving cavity but greater than a diameter of the front flange, an inner diameter of the opening being equal to a diameter of the mating end of the contact assembly, the stabilizing ring having a slot which extends from the opening to an outside circumference of the stabilizing ring to allow the stabilizing ring to be resiliently retained on the mating portion of the contact assembly;

wherein the stabilizing ring limits the movement of the mating portion of the contact assembly in a direction which is transverse to a longitudinal axis of the contact assembly.

2. The coaxial connector as recited in claim 1, wherein the stabilizing insert has a shoulder which cooperates with the front flange of the contact assembly.

3. The coaxial connector as recited in claim 2, wherein a radial gap is provided between the shoulder of the stabilizing insert and a circumferential surface of the front flange when the contact assembly is properly centered in the contact receiving cavity.

4. The coaxial connector as recited in claim 3, wherein the radial gap is ten thousands of an inch or less.

5. A coaxial connector assembly comprising:

a housing having a mating end and an oppositely facing contact assembly receiving end, the housing having at least one contact receiving cavity which extends from the mating end to the contact assembly receiving end,;

a contact assembly having a shell and a center contact, the contact assembly having a front flange proximate a mating portion of the contact assembly;

a substantially flat stabilizing ring positioned on the mating portion of the contact assembly, the stabilizing ring having an opening provided in the center, an outer diameter of the stabilizing ring being smaller than a diameter of the contact receiving cavity but greater than a diameter of the front flange, the stabilizing ring having tooling recesses on an outside edge of the stabilizing ring the stabilizing ring having a slot which extends from the opening to an outside circumference of the stabilizing ring to allow the stabilizing ring to be resiliently retained on the mating portion of the contact assembly;

wherein the stabilizing ring limits the movement of the mating portion of the contact assembly in a direction which is transverse to a longitudinal axis of the contact assembly.

6. The coaxial connector as recited in claim 5, wherein the stabilizing ring has recesses provided about a circumference of the stabilizing ring to allow for the use of a tool to properly position and remove the stabilizing ring.

7. The coaxial connector as recited in claim 5, wherein the stabilizing ring is a metallic ring.

8. The coaxial connector as recited in claim 5, wherein the stabilizing ring is a ring made of ferrous material.

9. The coaxial connector as recited in claim 5, wherein the stabilizing ring is a plastic member.

10. The coaxial connector as recited in claim 5, wherein the stabilizing ring is a rubber member.

11. The coaxial connector as recited in claim 5, wherein a radial gap is provided between the outer diameter of the stabilizing ring and the diameter of the contact receiving cavity when the stabilizing ring is properly centered in the contact receiving cavity.

12. The coaxial connector as recited in claim 11, wherein the radial gap is ten thousands of an inch or less.

* * * * *